US007029304B2

(12) United States Patent
Montena

(10) Patent No.: US 7,029,304 B2
(45) Date of Patent: Apr. 18, 2006

(54) COMPRESSION CONNECTOR WITH INTEGRAL COUPLER

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 8 days.

(21) Appl. No.: 10/771,899

(22) Filed: Feb. 4, 2004

(65) Prior Publication Data

US 2005/0170692 A1 Aug. 4, 2005

(51) Int. Cl.
*H01R 13/62* (2006.01)

(52) U.S. Cl. ..... 439/320

(58) Field of Classification Search ..... 439/320, 439/322, 578, 583, 584
See application file for complete search history.

(56) References Cited

U.S. PATENT DOCUMENTS

| | | | | |
|---|---|---|---|---|
| 2,258,737 | A | 10/1941 | Browne | |
| 3,184,706 | A | 5/1965 | Atkins | |
| 3,275,913 | A | 9/1966 | Blanchard | |
| 3,355,698 | A | 11/1967 | Keller | |
| 3,406,373 | A | 10/1968 | Forney, Jr. | |
| 3,498,647 | A | 3/1970 | Schroder | |
| 3,603,912 | A | 9/1971 | Kelly | |
| 3,629,792 | A | 12/1971 | Dorrell | |
| 3,671,922 | A | 6/1972 | Zerlin et al. | |
| 3,845,453 | A | 10/1974 | Hemmer | |
| 3,879,102 | A * | 4/1975 | Horak | 439/89 |
| 3,915,539 | A | 10/1975 | Collins | |
| 3,936,132 | A | 2/1976 | Hutter | |
| 3,985,418 | A | 10/1976 | Spinner | |
| 4,046,451 | A | 9/1977 | Juds et al. | |
| 4,053,200 | A | 10/1977 | Pugner | |
| 4,059,330 | A | 11/1977 | Shirey | |
| 4,126,372 | A | 11/1978 | Hashimoto et al. | |
| 4,156,554 | A | 5/1979 | Aujla | |
| 4,168,921 | A | 9/1979 | Blanchard | |
| 4,173,385 | A | 11/1979 | Fenn et al. | |
| 4,227,765 | A | 10/1980 | Neumann et al. | |
| 4,280,749 | A | 7/1981 | Hemmer | |
| 4,339,166 | A | 7/1982 | Dayton | |
| 4,346,958 | A | 8/1982 | Blanchard | |
| 4,354,721 | A | 10/1982 | Luzzi | |
| 4,373,767 | A | 2/1983 | Cairns | |
| 4,400,050 | A | 8/1983 | Hayward | |
| 4,408,821 | A | 10/1983 | Forney, Jr. | |

(Continued)

FOREIGN PATENT DOCUMENTS

| | | |
|---|---|---|
| DE | 1 191 880 | 4/1954 |

(Continued)

*Primary Examiner*—Phuong Dinh
(74) *Attorney, Agent, or Firm*—Wall Marjama & Bilinski LLP

(57) ABSTRACT

A compression connector body for connecting a hardline cable to an equipment port is formed in two members coupled to each other by a coupling nut. A port-side member houses a conductive pin and associated elements, while a cable-side member is attached to the cable via a compression fit. With this arrangement, when servicing the equipment, the cable-side member and attached cable are removed from the port-side member without affecting the connection between the cable and the cable-side member. The port-side member is then disconnected from the equipment port. After servicing the equipment, the port-side member is reconnected to the equipment port, after which the cable-side member is reconnected to the port-side member, thus alleviating the need to cut and prepare a new length of cable for connection to the equipment port.

4 Claims, 6 Drawing Sheets

U.S. PATENT DOCUMENTS 4,444,453 A 4/1984 Kirby et al.
4,484,792 A 11/1984 Tengler et al.
4,533,191 A 8/1985 Blackwood
4,545,637 A 10/1985 Bosshard et al.
4,575,274 A 3/1986 Hayward
4,583,811 A 4/1986 McMills
4,596,435 A 6/1986 Bickford
4,600,263 A 7/1986 DeChamp et al.
4,614,390 A 9/1986 Baker
4,645,281 A 2/1987 Burger
4,648,684 A 3/1987 Mattis et al.
4,650,228 A 3/1987 McMills et al.
4,655,159 A 4/1987 McMills
4,660,921 A 4/1987 Hauver
4,668,043 A 5/1987 Saba et al.
4,674,818 A 6/1987 McMills et al.
4,684,201 A 8/1987 Hutter
4,691,976 A 9/1987 Cowen
4,717,355 A 1/1988 Mattis
4,738,009 A 4/1988 Down
4,746,305 A 5/1988 Nomura
4,747,786 A 5/1988 Hayashi et al.
4,755,152 A 7/1988 Elliot et al.
4,806,116 A 2/1989 Ackerman
4,813,886 A 3/1989 Roos et al.
4,834,675 A 5/1989 Samchisen
4,857,014 A 8/1989 Alf et al.
4,869,679 A 9/1989 Szegda
4,892,275 A 1/1990 Szegda
4,902,246 A 2/1990 Samchisen
4,906,207 A 3/1990 Banning et al.
4,923,412 A * 5/1990 Morris ..... 439/578
4,925,403 A 5/1990 Zorzy
4,929,188 A 5/1990 Lionetto et al.
4,990,104 A 2/1991 Schieferly
4,990,105 A 2/1991 Karlovich
4,990,106 A * 2/1991 Szegda ..... 439/585
5,002,503 A 3/1991 Campbell et al.
5,021,010 A 6/1991 Wright
5,024,606 A 6/1991 Ming-Hwa
5,037,328 A 8/1991 Karlovich
5,062,804 A 11/1991 Jamet et al.
5,066,248 A 11/1991 Gaver
5,073,129 A 12/1991 Szegda
5,083,943 A 1/1992 Tarrant
5,127,853 A 7/1992 McMills et al.
5,131,862 A 7/1992 Gershfeld
5,141,451 A 8/1992 Down
5,181,161 A 1/1993 Hirose et al.
5,195,906 A 3/1993 Szegda
5,205,761 A 4/1993 Nilsson
5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,283,853 A 2/1994 Szegda
5,295,864 A 3/1994 Birch et al.
5,316,494 A 5/1994 Flanagan et al.
5,338,225 A 8/1994 Jacobsen et al.
5,342,218 A 8/1994 McMills et al.
5,371,819 A 12/1994 Szegda
5,371,821 A 12/1994 Szegda
5,371,827 A 12/1994 Szegda
5,393,244 A 2/1995 Szegda
5,431,583 A 7/1995 Szegda
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,494,454 A 2/1996 Johnsen
5,499,934 A 3/1996 Jacobsen et al.
5,501,616 A 3/1996 Holliday
5,525,076 A 6/1996 Down
5,542,861 A 8/1996 Anhalt et al.
5,548,088 A 8/1996 Gray et al.
5,571,028 A 11/1996 Szegda
5,598,132 A 1/1997 Stabile
5,607,325 A 3/1997 Toma
5,632,651 A 5/1997 Szegda
5,651,699 A 7/1997 Holliday
5,667,405 A 9/1997 Holliday
5,863,220 A 1/1999 Holliday
6,032,358 A 3/2000 Wild
6,802,738 B1 * 10/2004 Henningsen ..... 439/583
2005/0032422 A1 * 2/2005 Montena et al. ..... 439/583

FOREIGN PATENT DOCUMENTS

EP 0 265 276 4/1988
GB 1087 228 10/1967
GB 1270 846 4/1972
GB 2019 665 10/1979
GB 2079 549 A 1/1982

* cited by examiner

COMPRESSION CONNECTOR WITH INTEGRAL COUPLER

FIELD OF THE INVENTION

This invention relates generally to the field of coaxial cable connectors, and more particularly to a compression coupler connector used with hard-line coaxial cables.

BACKGROUND OF THE INVENTION

Coaxial cable is a typical transmission medium used in communications networks, such as a CATV network. The cables which make up the transmission portion of the network are typically of the "hard-line" type, while those used to distribute the signals into residences and businesses are typically "drop" connectors. The principal difference between hard-line and drop cables, apart from the size of the cables, is that hard-line cables include a rigid or semi-rigid outer conductor, typically covered with a weather protective jacket, that effectively prevents radiation leakage and protects the inner conductor and dielectric, while drop connectors include a relatively flexible outer conductor, typically braided, that permits their bending around obstacles between the transition or junction box and the location of the device to which the signal is being carried, i.e., a television, computer, and the like, but that is not as effective at preventing radiation leakage. Hard-line conductors, by contrast, generally span considerable distances along relatively straight paths, thereby virtually eliminating the need for a cable's flexibility. Due to the differences in size, material composition, and performance characteristics of hard-line and drop connectors, there are different technical considerations involved in the design of the connectors used with these types of cables.

In constructing and maintaining a network, such as a CATV network, the transmission cables are often interconnected to electrical equipment that conditions the signal being transmitted. The electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port without disrupting the ground connection of the cable. This requires a skilled technician to effect the interconnection.

Currently, when using a commercially available three piece connector, it is not practical to secure the connector on the outer conductor of the cable prior to securing the front and back portions of the connector to one another. To do so would prevent the portion secured to the cable from turning freely, thus preventing it being easily threaded onto the portion secured in the line equipment (taps, amplifiers, etc.). Instead, the installer is required to hold the cable firmly butted in the connector while tightening the two portions of the connector together; otherwise, there is the possibility of the center conductor seizure mechanism securing the center conductor in the wrong position (leading to inadequate cable retention and electrical connection). Having to hold the cable in place, while also having to manipulate two wrenches, can be inconvenient. In addition, it is not possible to disconnect the cable from the line equipment without first releasing the cable from the connector, thus breaking what might otherwise have been a good connection in order to perform service or testing. Often, in order to ensure a good connection when reinstalled, it is standard practice to cut and re-prepare the cable, which eventually shortens the cable to the point where a section of additional cable needs to be spliced or connected in.

SUMMARY OF THE INVENTION

Briefly stated, a compression connector body for connecting a hardline cable to an equipment port is formed in two members coupled to each other by a coupling nut. A port-side member houses a conductive pin and associated elements, while a cable-side member is attached to the cable via a compression fit. With this arrangement, when servicing the equipment, the cable-side member and attached cable are removed from the port-side member without affecting the connection between the cable and the cable-side member. The port-side member is then disconnected from the equipment port. After servicing the equipment, the port-side member is reconnected to the equipment port, after which the cable-side member is reconnected to the port-side member, thus alleviating the need to cut and prepare a new length of cable for connection to the equipment port.

According to an embodiment of the invention, a cable connector includes a front body adapted to connect to an equipment port; a back body adapted to receive a prepared end of a hardline coaxial cable; a coupler nut retained on the back body which screws into the front body; a conductive pin retained in the front body by an insulator, the conductive pin including a front end for connecting to the equipment port and a back end, wherein the back end includes a collet for connecting to and retaining a center conductor of the cable; a mandrel retained in the back body; means for connecting the cable to the back body; a shoulder formed in a front end of the back body; and a ridge on an inside of the coupler nut, wherein the coupler nut is retained on the back body between the shoulder of the back body and a shoulder of the mandrel.

According to an embodiment of the invention, a method of constructing a cable connector includes the steps of (a) providing a front body adapted to connect to an equipment port; (b) adapting a back body to receive a prepared end of a hardline coaxial cable; (c) retaining a coupler nut retained on the back body which screws into the front body; (d) retaining a conductive pin in the front body by an insulator, the conductive pin including a front end for connecting to the equipment port and a back end, wherein the back end includes a collet for connecting to and retaining a center conductor of the cable; (e) retaining a mandrel in the back body; (f) connecting the cable to the back body; (g) forming a shoulder in a front end of the back body; (h) forming a ridge on an inside of the coupler nut; and (i) retaining the coupler nut on the back body between the shoulder of the back body and a shoulder of the mandrel.

DETAILED DESCRIPTION OF THE PREFERRED EMBODIMENT

Figure 1:
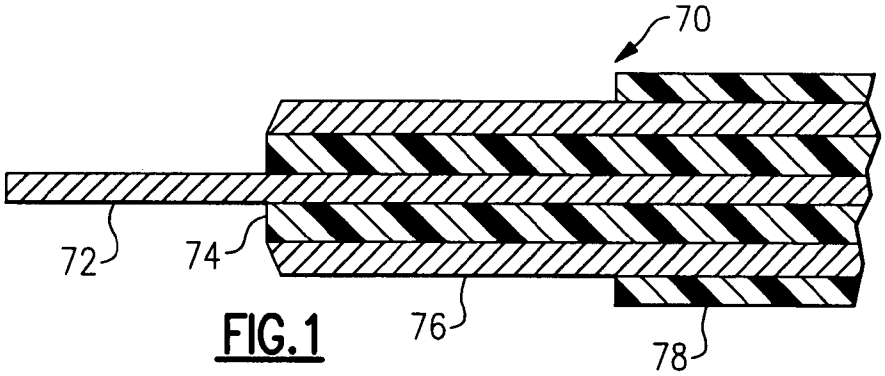
FIG.1 Prior Art
FIG. 1 shows a cross-sectional view of a coaxial cable.

Referring to FIG. 1, a cross-section of a coaxial cable 70 is shown. A center conductor 72 is surrounded by a dielectric 74 which in turn is surrounded by a ground sheath 76. These layers are then surrounded by an outer coating 78. Center conductor 72 and ground sheath 76 must be electrically conductive, while dielectric 74 must be an electrical insulator. Cable 70 is shown in a "prepared" configuration, with center conductor 72 extending from dielectric 74 and ground sheath 76, and outer coating 78 pulled back from the other layers.

Figure 2:
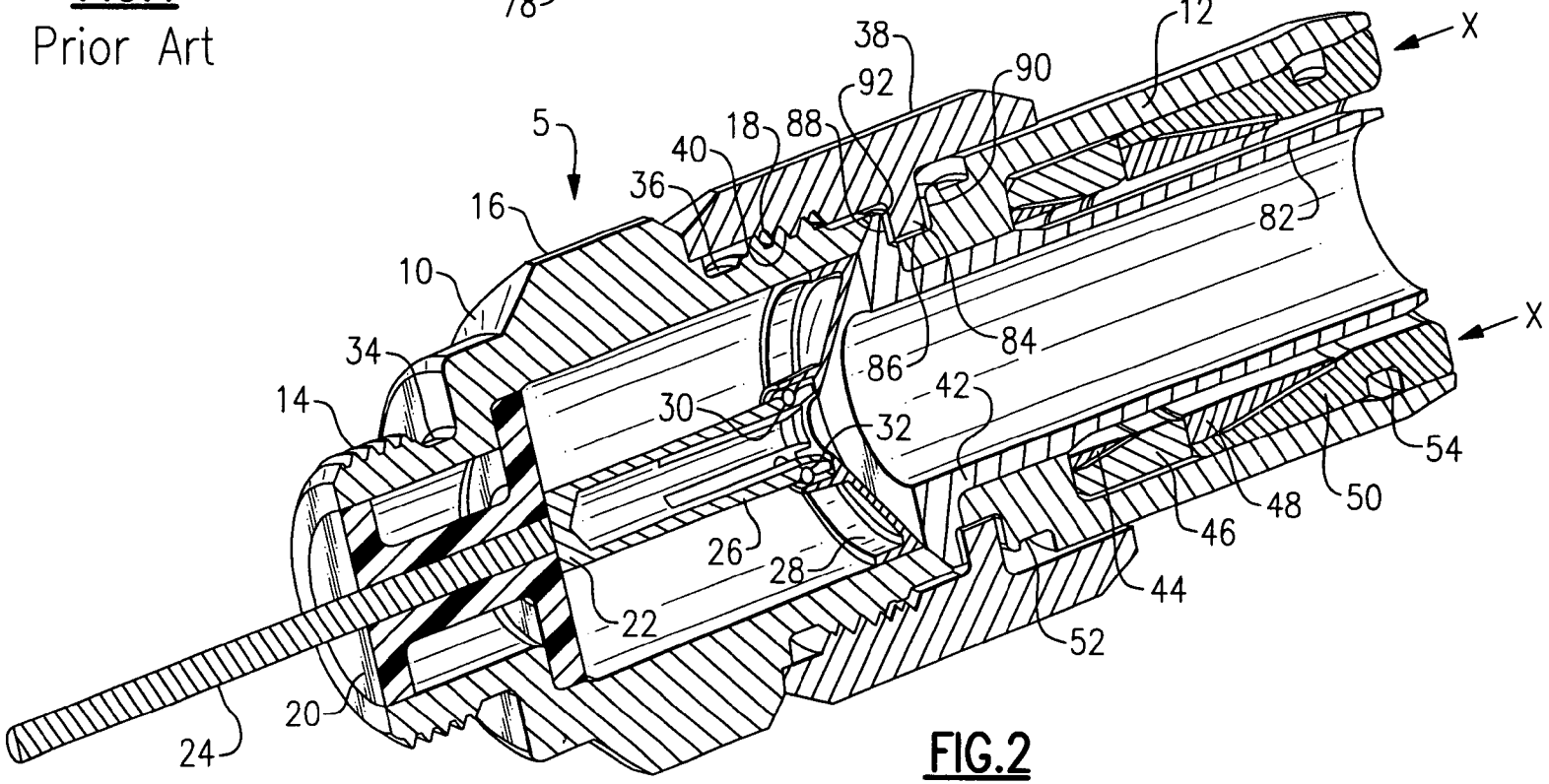
FIG. 2 shows a cutaway perspective view of an embodiment of the present invention.
Figure 3:
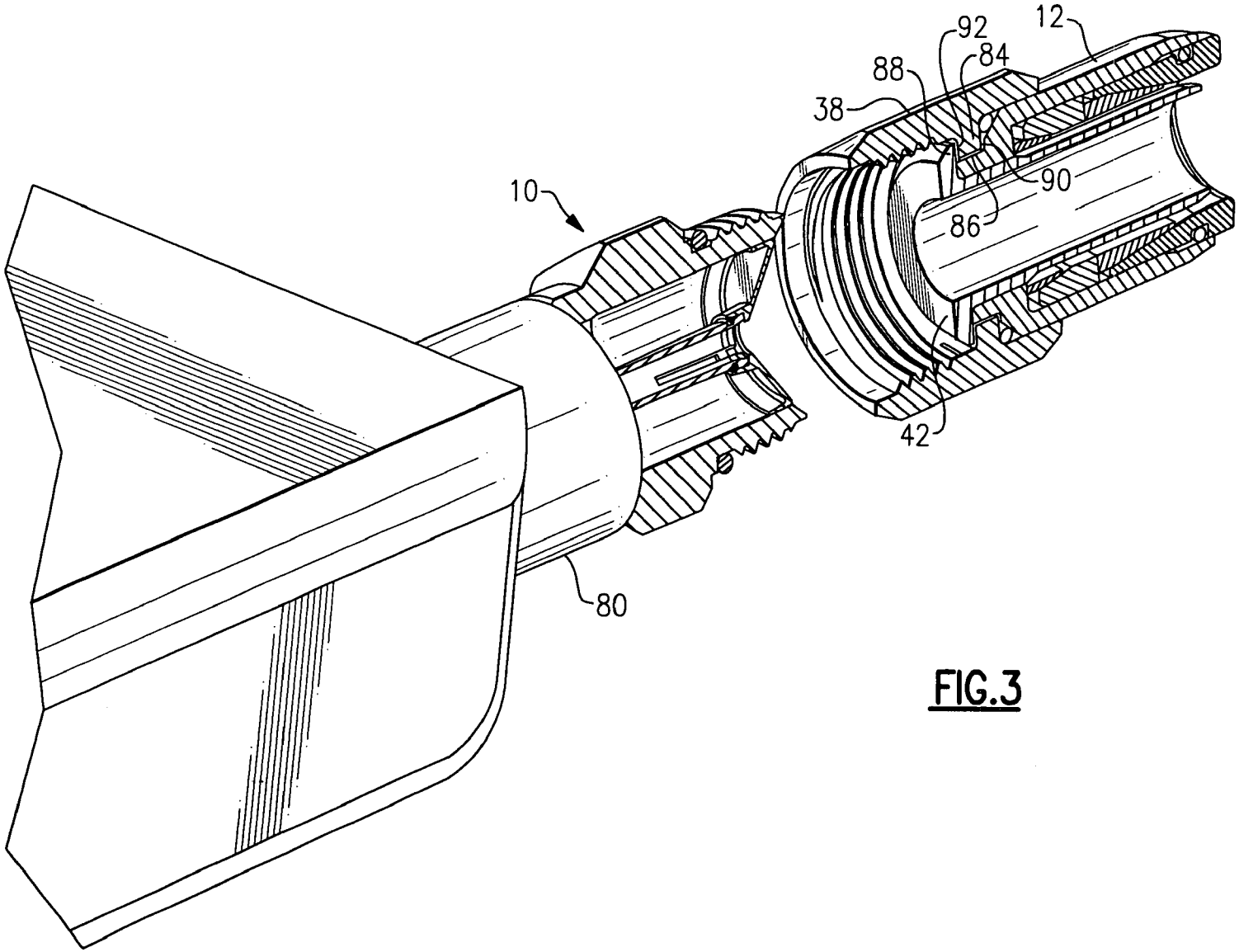
FIG. 3 shows a cutaway perspective view of the embodiment of FIG. 2 depicting a stage in connecting a coaxial cable to an equipment port.

Referring to FIG. 2, an embodiment of a coaxial cable connector 5 is shown. A front body 10 interconnects with a back body 12 via a coupler nut 38. Front body 10 includes a plurality of threads 14 which screw connector 5 to an equipment port 80 (FIG. 3). Front body 10 further includes an annular groove 34 which holds an O-ring (not shown) which seals front body 10 to equipment port 80 when connector 5 is installed, in addition to an annular groove 36 for an O-ring (not shown). Front body 10 also includes a plurality of external threads 18. Front body 10 contains a contact insulator 20 which insulates a pin portion 24 of a contact 22 from accidental grounding. Contact 22 includes a collet portion 26 which seizes and holds center conductor 72 of coaxial cable 70. A guide 28 for center conductor 72 preferably fits over a ring 30 which lies in an annular groove 32 in collet portion 26. Ring 30 contributes to the spring force of collet portion 26 which seizes and holds center conductor 72 when center conductor 72 is inserted into collet portion 26. Ring 30 is preferably a "C-clip" such as the VH & VS Light Duty Series of retaining rings, the FH & FS/FHE & FSE Series Snap Rings, or the Special Spiral Retaining Rings with special ends, all of which are manufactured by Smedley Steel Company (www.smalley.com).

Back body 12 contains a mandrel 42, which is optionally integral with guide 28. Between a portion 82 of mandrel 42 and back body 12 are various elements of a compression fitting, i.e., RFI seal 44, ramp 46, clamp seal 48, compression ring 50, and annular groove 54 for an O-ring (not shown), which are described in detail in U.S. patent application Ser. No. 10/686,204 filed on Oct. 15, 2003 and entitled APPARATUS FOR MAKING PERMANENT HARDLINE CONNECTION, incorporated herein by reference. Back body 12 includes an annular groove 52 for an O-ring (not shown). When cable 70 is connected to back body 12 of connector 5, portion 82 of mandrel 42 fits between ground sheath 76 and dielectric 74 so that the elements of the compression fitting clamp onto ground sheath 76 when an axial force X is applied as indicated to the compression fitting. Although connector 5 is intended for use with a permanent compression fitting, use with a threaded fitting or crimp-style fitting is also possible to provide similar advantages.

Coupler nut 38 includes a plurality of internal threads 40 which interface with external threads 18 of front body 10. A ridge 84 of coupler nut 38 fits within an annular channel 86 formed by a mandrel shoulder 88 and a back body shoulder 90. A plastic thrust bearing 92 disposed between ridge 84 and shoulder 88 permits coupler nut 38 to rotate onto front body 10 when being tightened or loosened. Coupler nut 38 is a free wheeling coupler nut in that it turns without hindrance when threads 40 are not interacting with threads 18.

Figure 4:
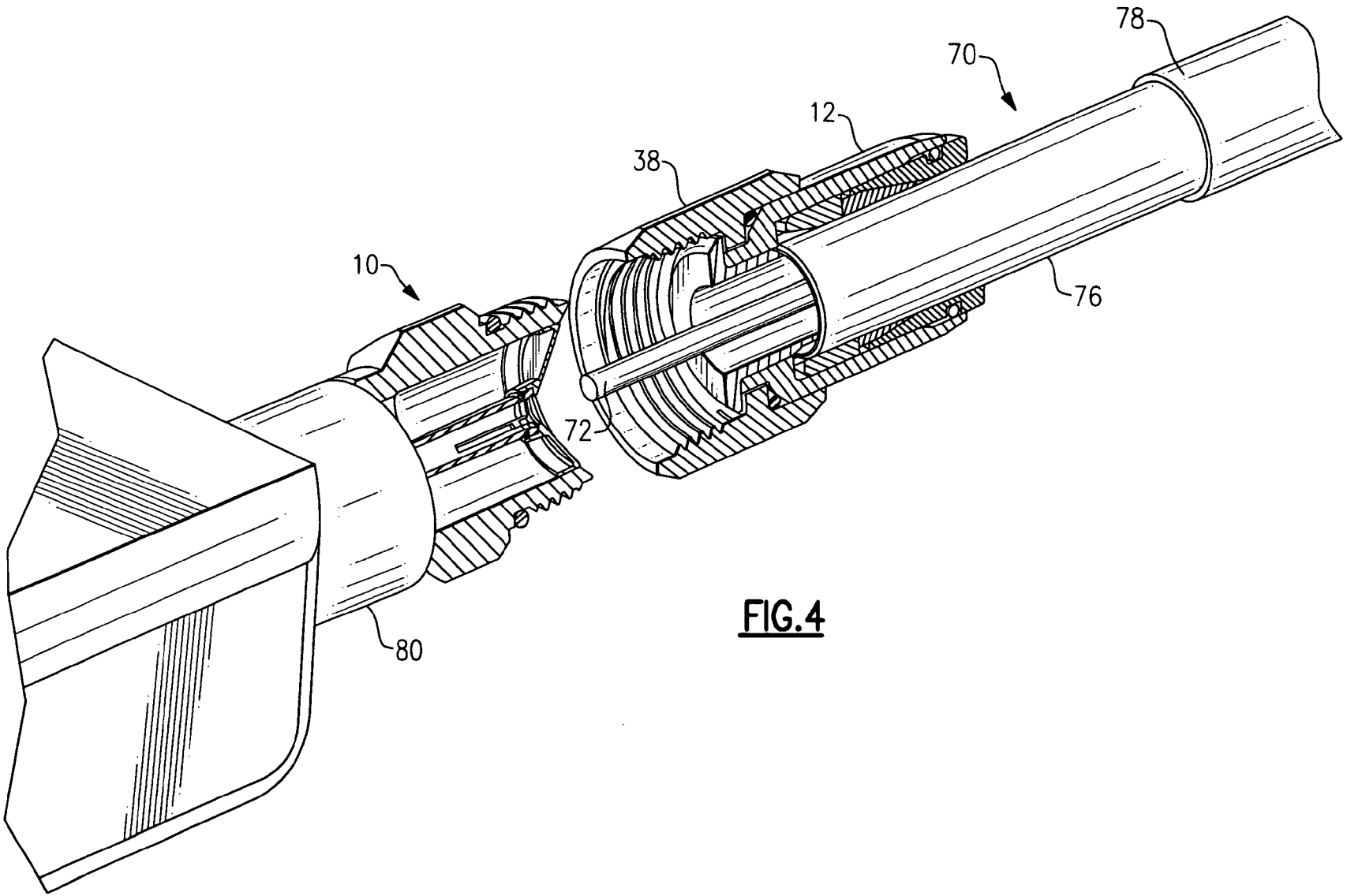
FIG. 4 shows a cutaway perspective view of the embodiment of FIG. 2 depicting a stage in connecting a coaxial cable to an equipment port.
Figure 5:
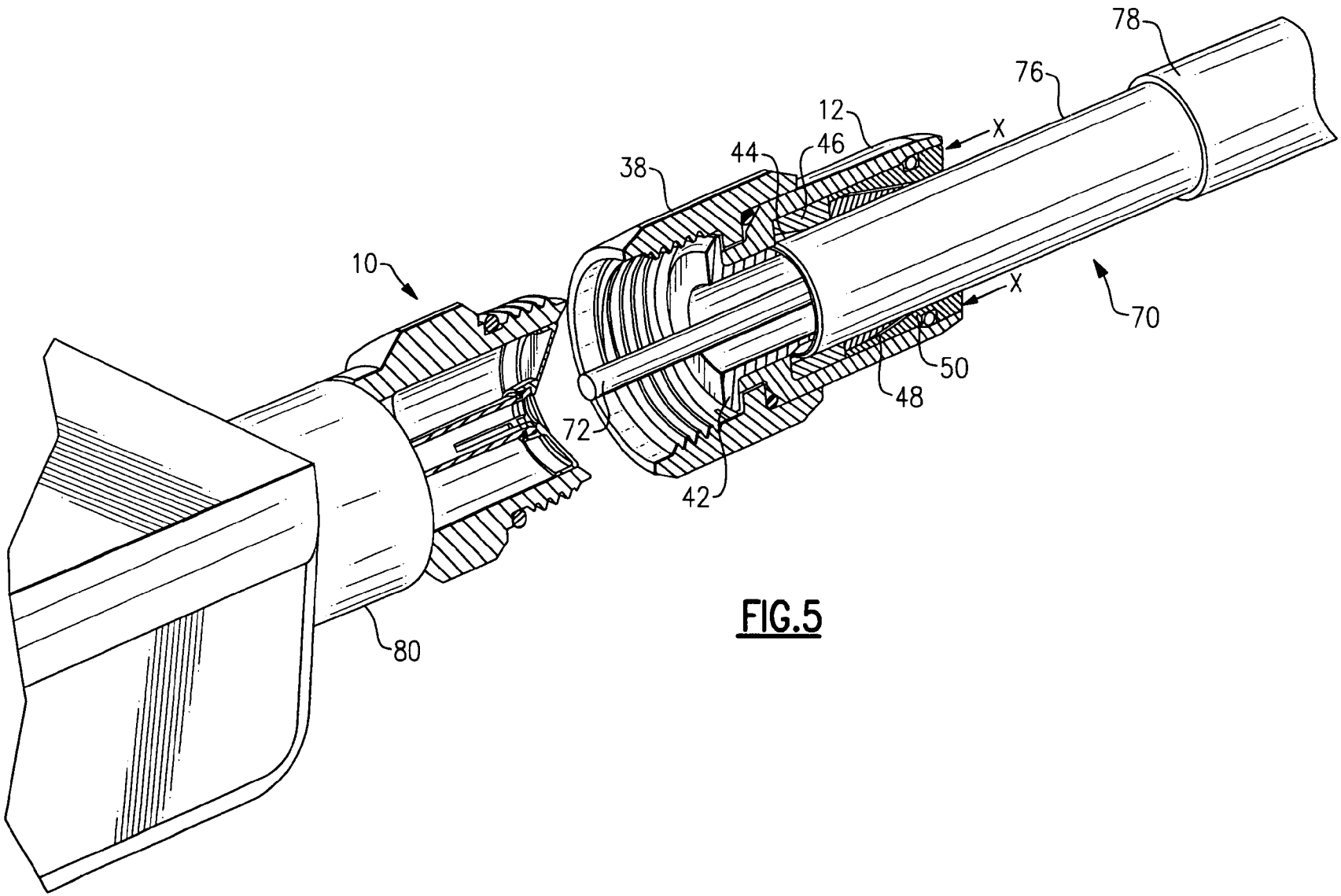
FIG. 5 shows a cutaway perspective view of the embodiment of FIG. 2 depicting a stage in connecting a coaxial cable to an equipment port.
Figure 6:
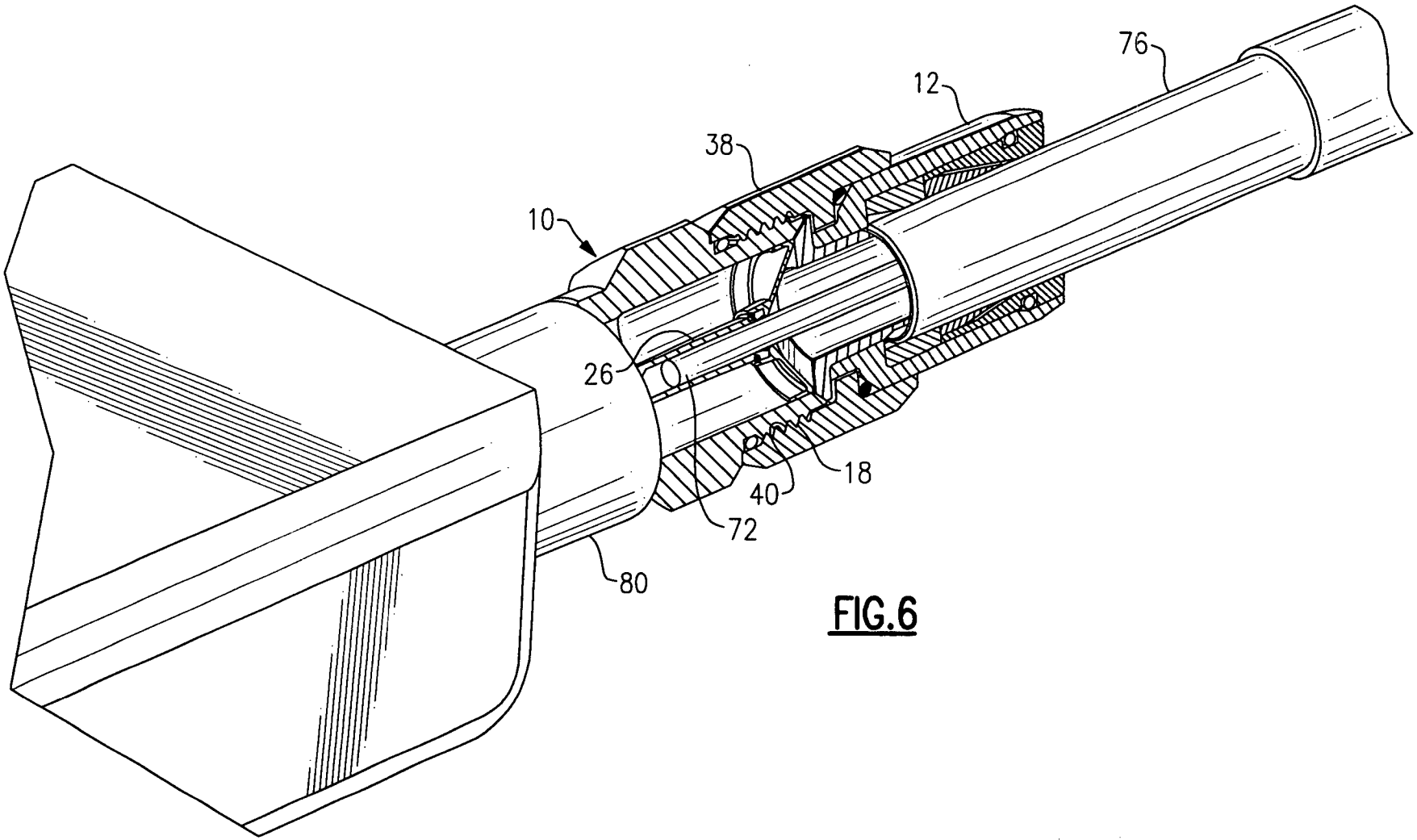
FIG. 6 shows a cutaway perspective view of the embodiment of FIG. 2 depicting a stage in connecting a coaxial cable to an equipment port.
Figure 7:
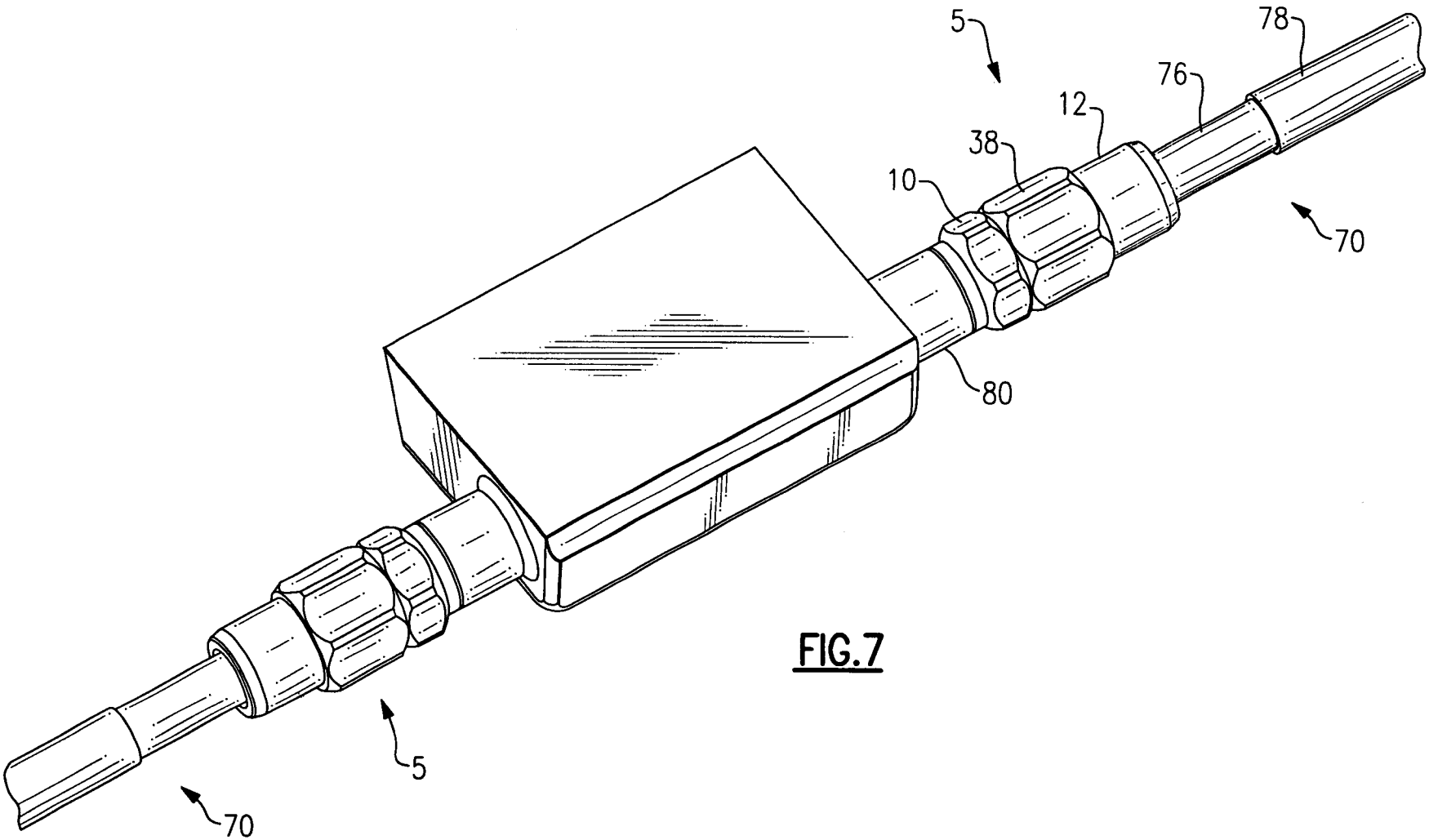
FIG. 7 shows a perspective view of the embodiment of FIG. 2 connecting a coaxial cable to an equipment port.

Referring to FIGS. 3–7, coaxial cable 70 is connected to equipment port 80 as follows. As shown in FIG. 3, front body 10 is screwed into equipment port 80 or other connection. Note that coupler nut 38 is already installed on back body 12. As shown in FIG. 4, a prepared end of cable 70 is inserted through the rear of back body 12. As shown in FIG. 5, cable 70 is connected to back body 12 of connector 5 by applying compressive axial force X as indicated. Then, as shown in FIG. 6, center conductor 72 is inserted into collet portion 26 where the spring action of collet portion 26 helps to secure center conductor 72 to contact 22, after which coupler nut 38 is screwed onto front body 10. As shown in FIG. 7, cable 70 is now connected to equipment port 80 by connector 5. The connection can be broken easily for equipment service without removing connector 5 from cable 70 simply by unscrewing coupler nut 38 from front body 10. After servicing the equipment, screwing coupler nut 38 onto front body 10 reconnects cable 70 to equipment port 80. Because connector 5 does not require heat shrink, the use and re-use of connector 5 is advantageous in that there is no time spent in removing the heat shrink, there is no time spent trying to release cable 70 from back body 12, and there are fewer service calls resulting from the ingress/egress moisture damage associated with man-handling cable using ordinary connectors. The number of service call backs is also educed because the RF shielding, the environmental seal, and the grip on the cable are never degraded by multiple uses. Once the ground connection is established upon initial installation, it is never broken again.

Connector 5 is intended for use with bonded cables only. In order to provide the benefits of damage-free multiple disconnects, the connector does not "seize" the center conductor in the same manner as traditional hardline connectors. Electrical contact is firm and reliable, with insertion loss meeting SCTE specifications, but axial movement of the center conductor in and out of the terminal is allowed without the possibility of buckling or elongation of the center conductor. Using bonded cable prevents the possibility of "suck out" in cold weather. What little independent motion of the center conductor that may occur is safeguarded by overlap of the contact point and the end of the center conductor.

The uniqueness of the coupler design for hardline connectors lies in the connector's ability to remain completely attached to the outer conductor of the cable, while still allowing disconnection of the cable and connector from an equipment port. It does this in much the same manner as a typical connector for drop (flexible) coaxial cable. However, instead of simply providing a feed-through connection where the cable passes through the connector into the equipment, the hardline coupler connector uses an integral interface adapter which connects between the port and the cable. This portion of the connector remains in the equipment port when the connector is separated. In addition, there are substantial differences between the drop cable where typical drop connectors are used, and the hard line cable where the coupler would be used, in construction, use, and preparation.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A cable connector comprising:

a front body adapted to connect to an equipment port;

a back body adapted to receive a prepared end of a hardline coaxial cable;

a coupler nut retained on said back body which screws into said front body;

a conductive pin retained in said front body by an insulator, said conductive pin including a front end for connecting to said equipment port and a back end, wherein said back end includes a collet for connecting to and retaining a center conductor of said cable and a ring which enhances an interference fit between said collet and said center conductor of said cable;

a mandrel retained in said back body;

a permanent compression fitting retained in said back body;

a shoulder formed in a front end of said back body;

a ridge on an inside of said coupler nut, wherein said coupler nut is retained on said back body between said shoulder of said back body and a shoulder of said mandrel, whereby the front body can be detached from the coupler nut without adversely affecting the means for connecting said cable to said back body; and a thrust bearing disposed between said ridge and said shoulder of said mandrel.

2. A cable connector according to claim 1, further comprising a guide disposed within said front body, wherein a portion of said guide fits over said ring.

3. A method of constructing a cable connector, comprising the steps of:

providing a front body adapted to connect to an equipment port;

adapting a back body to receive a prepared end of a hardline coaxial cable;

retaining a coupler nut retained on said back body which screws into said front body;

retaining a conductive pin in said front body by an insulator, said conductive pin including a front end for connecting to said equipment port and a back end, wherein said back end includes a collet for connecting to and retaining a center conductor of said cable;

disposing a ring around an end of said collet which enhances an interference fit between said collet and said center conductor of said cable;

retaining a mandrel in said back body;

connecting said cable to said back body using a permanent compression fitting retained in said back body;

forming a shoulder in a front end of said back body; forming a ridge on an inside of said coupler nut;

retaining said coupler nut on said back body between said shoulder of said back body and a shoulder of said mandrel, whereby the front body can be detached from the coupler nut without adversely affecting the connection of said cable to said back body; and disposing a thrust bearing between said ridge and said shoulder of said mandrel.

4. A method according to claim 3, further comprising disposing a guide within said front body, wherein a portion of said guide fits over said ring.

* * * * *